United States Patent [19]

Andersson

[11] 4,151,780

[45] May 1, 1979

[54] DEVICE FOR RECOILLESS FIRING OF A MISSILE

[75] Inventor: Claes R. Andersson, Karlskoga, Sweden

[73] Assignee: AB Bofors, Bofors, Sweden

[21] Appl. No.: 797,644

[22] Filed: May 16, 1977

[30] Foreign Application Priority Data

May 17, 1976 [SE] Sweden ..... 7605570

[51] Int. Cl.[2] ..... F41F 3/02; F41F 15/00

[52] U.S. Cl. ..... 89/1.7; 89/1.818

[58] Field of Search ..... 89/1.818, 1.816, 1.705, 89/1.704, 1.7

[56] References Cited

U.S. PATENT DOCUMENTS

| | | | |
|---|---|---|---|
| 1,661,091 | 2/1928 | Riabouchinski | 89/1.816 |
| 2,965,000 | 12/1960 | Skinner | 89/1.7 |
| 3,011,406 | 12/1961 | Werle et al. | 89/1.818 |
| 3,298,278 | 1/1967 | Barakauskas | 89/1.818 X |
| 3,610,093 | 10/1971 | Mebus | 89/1.7 |

FOREIGN PATENT DOCUMENTS

| | | | |
|---|---|---|---|
| 868494 | 4/1971 | Canada | 89/1.7 |

*Primary Examiner*—David H. Brown

*Attorney, Agent, or Firm*—Pollock, Vande Sande & Priddy

[57] ABSTRACT

A device providing for the recoilless firing of a missile from a launching tube and comprising a gas generator surrounding a rear portion of the tube, with a plurality of apertures formed in the tube and positioned to allow high pressure gas to pass from the gas generator into an area behind the missile to provide a sufficient launch force.

8 Claims, 3 Drawing Figures

DEVICE FOR RECOILLESS FIRING OF A MISSILE

BACKGROUND OF THE INVENTION

The present invention relates to a device for recoilless firing of a missile from a launching tube with the aid of a gas generator which produces a gas which forces the missile out of the launching tube.

When firing a missile from a launching tube, it is previously known to use a gas generator to produce a propellant gas which forces the missile from the launching tube. The advantage of utilizing a gas generator instead of a booster motor on the missile is, among other things, that the weight of the missile can be minimized, while simultaneously eliminating the problem of disengaging the booster motor from the missile after it has been fired.

A gas generator can be placed either inside the launching tube, at its rear part, or outside, and the propelling gas produced can then be conveyed to the rear part of the launching tube via a pipe.

The propelling gas produced in the gas generator is at high pressure, and retains sufficient driving pressure upon entering the space behind the missile, which gives the missile an acceleration forwards in the launching tube.

In order to achieve an appropriate distribution of the pressure behind the missile and freedom from recoil, previously known embodiments have provided deflection screens, nozzles etc. to direct the gas flow emitted from the gas generator. The surfaces which the gas flow strike must then be made of a material capable of withstanding the high velocities and temperatures developed in the propelling gas, making the device much more expensive.

OBJECTS AND SUMMARY OF THE INVENTION

The purpose of our invention is to create a simple and compact device for firing a missile from a launching tube, without any need for the use of deflection screens, nozzles or the like.

A preferred embodiment of the present invention includes a gas generator which is ring-shaped and is arranged around a launching tube, with, the propelling gas produced by the gas generator flowing radially inwards in the launching tube through a number of apertures located in the envelope surface of the launching tube.

DESCRIPTION OF THE DRAWINGS

In the following, a preferred embodiment of the invention will be described in more detail, with reference to the attached drawings, in which.

DETAILED DESCRIPTION OF A PREFERRED EMBODIMENT

Figure 1:
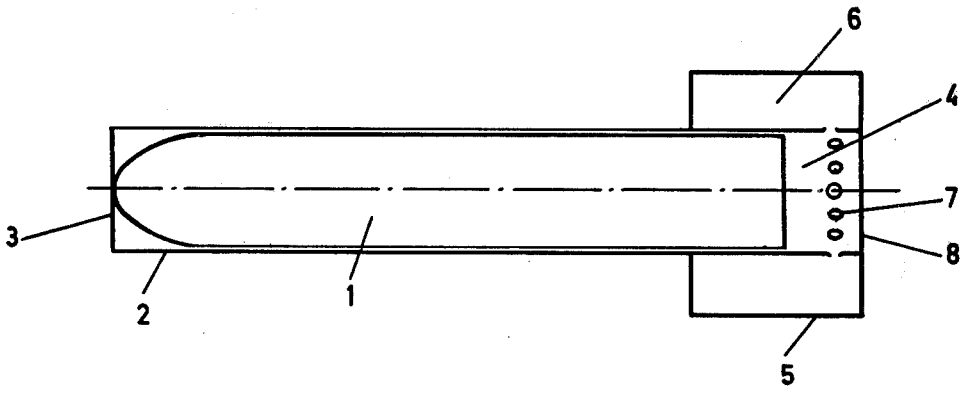
FIG. 1 shows a schematic view of the invention.

As will be noted from FIG. 1, a missile 1 is arranged in an elongate container 2, which can be provided with carrying members (not shown). The container 2 may be also intended to serve as a launching tube when firing the missile, and for this purpose is provided with members for setting it in a suitable firing position. However, these members do not constitute a part of the present invention, and therefore and not shown. For transport, the container 2 can moreover be provided with conventional front and rear covers (also not shown), which close the ends of the container.

During firing, missile 1 is given a forward acceleration through the launching tube 2, and passes out through its muzzle 3. The missile is forced out of launching tube 2 by a gas being which is allowed to expand under high pressure in a space 4 behind the mmissile 1. For this purpose, the launching tube 2 is provided with a gas generator 5, which produces a propelling gas, for instance a powder gas, which gives a high pressure.

Gas generator 5 is arranged outside the launching tube, and is located adjacent to rear portion of tuke 2. The actual gas generator 5 is ring-shaped, and comprises a ring-shaped, closed volume portion 6, which is in fluid connection with the space 4 in the launching tube 2 via a number of apertures 7 located in the envelope surface of tube 2. The centres of the aperture are arranged in a plane extending at right angles to the longitudinal axis of the launching tube 2. Further, the apertures are evenly distributed around the periphery of the envelope surface.

When missile 1 is to be fired, a powder charge may be initiated in the gas generator 5, producing a powder gas at a high pressure in the ring-shaped volume portion 6. The gas flows radially under pressure through apertures 7 into the space 4 in the launching tube 2. As the gas expands into the tube through the apertures 7, a jet cushion is formed, causing a gas pressure to be maintained behind the missile in the space 4; similar to the air cushion generated beneath a hovercraft. The entire mass of gas will be deflected rearwardly and out through rear opening 8 of the launching tube 2, with the exception of the quantity of gas required to maintain sufficient launch pressure in the tube as the missile 1 moves forwards. The system will be recoilless, with the exception of the friction force between the missile and the launching tube.

Figure 3:
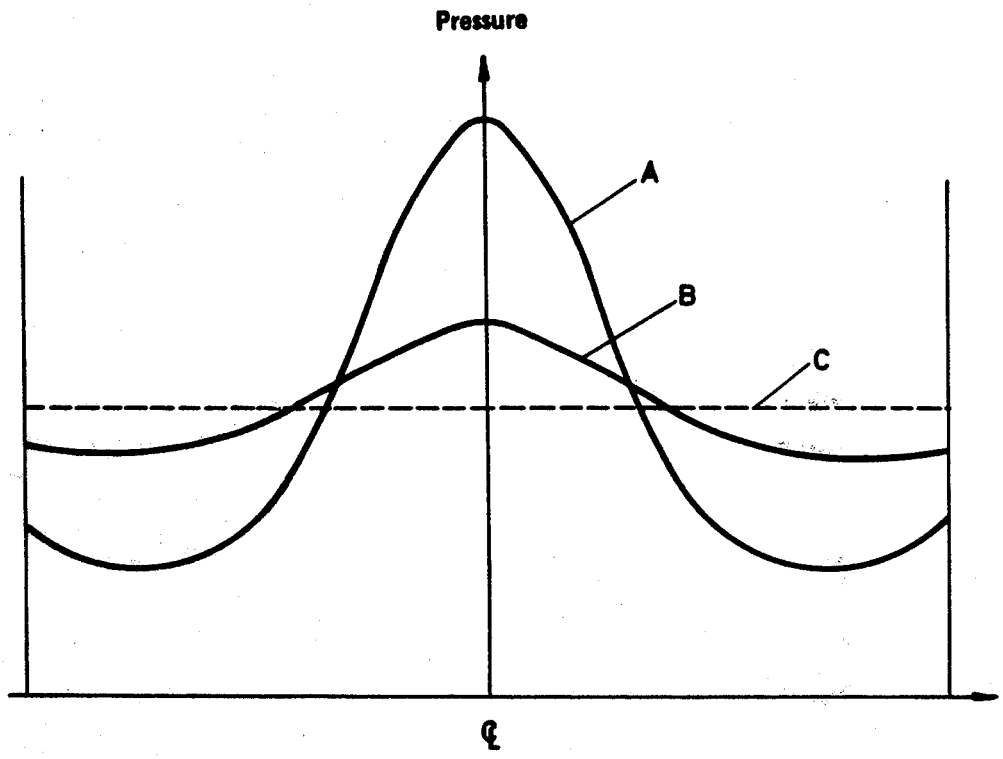
FIG. 3 shows a curve of the pressure distribution behind the missile.

The pressure generated behind the missile 1 will depend upon the gas data in the volume portion 6 of the gas generator 5, the area of the apertures 7, and the diameter of the launching tube 2. Independent of the position of the missile in the launching tube, the mean pressure and the resulting launch force on the missile will be constant. This results in the acceleration of the missile in the tube results constant. With the same total area, the pressure distribution behind the missile will be dependent on the number of apertures 7 in the separating wall between the volume 6 in the gas generator and the space 4 in the launching tube. See FIG. 3, which shows the pressure distribution in a diametral cross-section. A small number of apertures produces, curve A, showing great differences in pressure; while a large number of apertures produces, curve B showing a more even pressure.

Independent of the number of apertures, however, if the total area of the apertures is constant, the dash-line pressure curve C will be the same. The maximum pressure is obtained in the centre of the launching tube.

As the gas is blown radially into the launching tube 2, no deflection screen of the kind used for previously known designs is required. The system is therefore more favourable, as the gas jets which are developed by the gas generator have a high velocity and a high temperature.

Nor are there any surfaces which under the influence of the pressure could give rise to recoil forces in the direction of the launching tube. The ring-shaped gas generator 5 also has the advantage that the design can be made more compact, primarily by forming a shorter launching tube 2, in that the rear part of the missile can be placed near the cross-section plane in which the apertures 7 are arranged. Further, above system described has the advantage that no complicated nozzles are included in the design. The apertures 7 consist of simple so-called pipe nozzles, which have been achieved by drilling holes in the wall of the launching tube 2.

Figure 2:
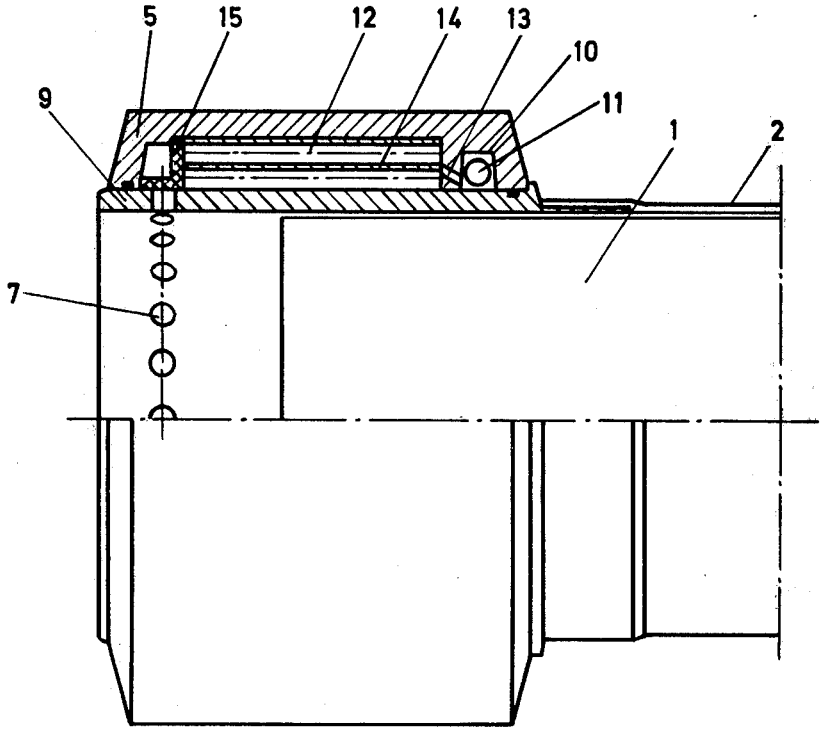
FIG. 2 is a side view, partly in cross-section, of the actual gas generator.

FIG. 2 shows a side view of the rear part of the launching tube 2, in which the ring-shaped gas generator 5 is illustrated in more detail. As will be noted in FIG. 2, the rear part of the launching tube has been reinforced by increasing the wall thickness at 9. The actual gas generator 5, which surrounds section 9 of the launching tube, consists of a tubular part which, with a good fit, is positioned on the reinforced section 9 of the launching tube. The gas generator 5 is made in such a way that two different spaces are formed between the outer wall of the gas generator and the envelope surface of the launching tube, viz. a first, smaller ring-shaped space 10 which contains a priming charge 11 for ignition of the main charge of the gas generator, and a larger, also ring-shaped space 12, which contains the main charge. The spaces 10 and 12 are connected with each other via a number of channels 13, so that hot flame gases formed during combustion of the priming charge can reach the main charge and provide ignition. The main charge consists of a number of powder tubes 14, arranged parallel to the longitudinal axis of the launching tube 2, and evenly distributed around the launching tube in the space 12. The powder tubes are held in place by means of a ring-shaped screen 15 with an L-shaped cross-section, which also covers the apertures 7 in the envelope surface of the launching tube. The screen has sufficiently fine mesh to prevent powder residue from spreading through the apertures 7, but allows the gas formed at the combustion of the powder tubes to pass freely. The apertures 7 in the envelope surface of the launching tube are directed radially and at right angles to the longitudinal axis of the launching tube, so that the gases formed expand radially inwards in the launching tube.

The invention is not limited to the embodiment shown above as an example, but can be subject to modifications within the scope of the following claims. Thus, instead of having the powder gas generator described, it is possible to use other types of gas generators, for instance compressed air driven, but a source of compressed air must then be connected to the ring-shaped gas generator.

I claim:

1. A launch assembly for providing recoilless firing of a missile-like device, and comprising:

a hollow launch tube surrounding and supporting said missile positioned therein, said launch tube including a ring shaped rear end portion of substantially constant diameter which is open at opposite ends and extending beyond a rear edge surface of said missile to form an open-ended empty chamber behind said missile;

a gas generating assembly surrounding and attached to an outer surface of said rear end portion and capable of providing high pressure gas adjacent said outer surface; and means for directing said high pressure gas radially inwardly from said gas generating assembly through a wall of said rear end portion and into said empty chamber to provide a force for recoilless launching of said missile.

2. A device according to claim 1, wherein said launch assembly comprises a cylindrically-shaped, tubular member.

3. A device according to claim 1, wherein said directing means comprises a plurality of apertures extending radially through a wall of said launch assembly to provide a flow path between said gas generating assembly and said empty chamber.

4. A device according to claim 3, wherein each of said apertures has a longitudinal axis extending therethrough which is perpendicular to said longitudinal axis of said launch assembly.

5. A device according to claim 1, wherein said gas generating assembly comprises an annularly-shaped member circumferentially surrounding said outer surface of said launch assembly and attached thereto.

6. A device according to claim 5, wherein said directing means comprises a plurality of apertures extending radially through a wall of said launch assembly, with said apertures being circumferentially spaced about said launch assembly.

7. A device according to claim 5, wherein said gas generating assembly includes at least one powder charge positioned in a tube extending parallel to a longitudinal axis of said launch assembly;

said gas generating assembly further including a priming charge with a passageway extending between said priming charge and said powder charge.

8. A device according to claim 7, wherein a plurality of powder charges are each positioned in a separate tube, with said tubes extending parallel to said longitudinal axis and circumferentially spaced about said outer surface of said launch assembly.

* * * * *